US006206088B1

(12) United States Patent
Semedard et al.

(10) Patent No.: US 6,206,088 B1
(45) Date of Patent: Mar. 27, 2001

(54) HEAT EXCHANGER SYSTEM FOR A BOILER HAVING A CIRCULATING FLUIDIZED BED

(75) Inventors: Jean-Claude Semedard, Paris; Pierre Gauville, Verrieres le Buisson; Christian Enault, Fontenay Aux Roses, all of (FR)

(73) Assignee: GEC Alsthom Stein Industrie, Velizy Villacoubley (FR)

( * ) Notice: Subject to any disclaimer, the term of this patent is extended or adjusted under 35 U.S.C. 154(b) by 0 days.

(21) Appl. No.: 09/134,863

(22) Filed: Aug. 17, 1998

(30) Foreign Application Priority Data

Aug. 18, 1997 (FR) ..... 97 10426

(51) Int. Cl.[7] ..... F28F 27/02

(52) U.S. Cl. ..... 165/104.16; 165/294; 165/296; 165/101; 422/146

(58) Field of Search ..... 165/100, 101, 165/104.16; 422/146, 173

(56) References Cited

U.S. PATENT DOCUMENTS

| | | | | |
|---|---|---|---|---|
| 2,518,270 | * | 8/1950 | Barr | 165/104.16 |
| 2,852,545 | * | 9/1958 | Jenny | 165/104.16 |
| 3,013,773 | * | 12/1961 | Campbell et al. | 165/104.16 |
| 3,156,538 | * | 11/1964 | Schneider | 165/104.16 |
| 3,814,176 | * | 6/1974 | Seth | 165/104.16 |
| 4,127,161 | * | 11/1978 | Clyne et al. | 165/294 |
| 4,515,205 | * | 5/1985 | Kawata | 165/104.16 |
| 4,553,502 | * | 11/1985 | Dreuilhe et al. | 165/104.16 |
| 4,601,328 | * | 7/1986 | Tasaka et al. | 165/294 |
| 4,738,309 | * | 4/1988 | Schilling | 165/101 |
| 4,945,980 | * | 8/1990 | Umezawa | 165/101 |
| 5,297,622 | * | 3/1994 | Brännström et al. | 165/104.16 |
| 5,369,597 | * | 11/1994 | Bujak, Jr. | 165/294 X |
| 5,855,241 | * | 1/1999 | Aubry | 165/104.16 |
| 5,954,000 | * | 9/1999 | Panos | 165/104.16 X |

FOREIGN PATENT DOCUMENTS

| | | | | |
|---|---|---|---|---|
| 0637569 | * | 3/1962 | (CA) | 165/104.16 |
| 1259787 | * | 3/1961 | (FR) | 165/104.16 |
| 1320230 | * | 5/1963 | (FR) | 165/104.16 |
| 403110390 | * | 5/1991 | (JP) | 165/104.16 |

* cited by examiner

*Primary Examiner*—Christopher Atkinson
(74) *Attorney, Agent, or Firm*—Sughrue, Mion, Zinn Macpeak & Seas, PLLC

(57) ABSTRACT

A heat exchanger system includes a first heat exchanger followed by a second heat exchanger disposed in a dense fluidized bed, the second heat exchanger being made up of a plurality of nests of tubes disposed along the path of the particles in suspension in the dense fluidized bed. The second heat exchanger is provided with at least two feeds situated on either side of its center, each of the feeds receives a distinct mixture of the input fluid and of the output fluid of the first heat exchanger, so that the temperature of the fluid fed into each of the nests is an increasing function of the distance between it and the inlet via which the particles are fed into the dense fluidized bed.

8 Claims, 3 Drawing Sheets

HEAT EXCHANGER SYSTEM FOR A BOILER HAVING A CIRCULATING FLUIDIZED BED

The present invention relates to a heat exchanger system for a boiler having a circulating fluidized bed.

BACKGROUND OF THE INVENTION

Such a boiler includes, inter alia, the following elements shown diagrammatically in FIG. 1:

- a hearth C for burning the fuel in a circulating fluidized bed of particles, the walls of the hearth comprising vertical pipes in which an emulsion (liquid phase and vapor phase) of water circulates, which emulsion is produced by evaporation of water fed into the bases of said pipes;
- a separator member S (in general a cyclone) which, at the top of the hearth, recovers the flue gas and the solid particles ejected from the top of the hearth and directs the flue gas and said particles to respective ones of two distinct ducts;
- a first heat exchanger ET1 often connected to the gas duct S1 of the separator member S, the first heat exchanger being, for example, an economizer, a vaporizer, a superheater or a resuperheater; and
- a dense fluidized bed ET2 fed with particles from the separator member S, i.e. that is connected firstly to the particles duct S2 of said separator member and secondly to the bottom of the hearth C (it is also possible to provide a dense fluidized bed ET2B that is fed with particles collected in the hearth C, i.e. connected firstly to the extraction duct of the hearth and secondly to the bottom of the hearth), the dense fluidized bed including a second heat exchanger whose inlet is connected to the outlet of the first heat exchanger ET1.

In general, the second heat exchanger is made up of a plurality of nests of tubes, each nest comprising a plurality of zigzag tubes arranged in parallel planes that are in general vertical. The coolant fluid, commonly steam, circulates in the nests, and the entire heat exchanger is integrated in a rectangular case.

Usually, the nests are disposed as follows: in succession starting from one wall of the case, a first nest optionally separated from the wall by a space without any zigzag tubes, then a second nest optionally separated from the first nest by a space without any zigzag tubes; the space between the first nest and the second nest may contain a physical separation such as a low wall or a partition; Any additional nests are arranged analogously, so that the last nest is optionally separated by a space without any zigzag tubes from that wall of the case which is opposite from the wall facing the first nest.

The feed duct for feeding the dense fluidized bed ET2 with particles is thus connected to a wall of the case or to the empty space between the first nest and said wall, the particles being returned to the hearth C via the opposite wall or via an outlet connected to the empty space between the last nest and the opposite wall.

The intense mixing of the particles tends to make the temperature inside the case uniform. However, since the particles leave the case colder than when they were fed into the case, the temperature is not the same everywhere. The tubes situated in the vicinity of the particles inlet receive more heat than those which are close to the outlet.

In addition, when the power of the boiler increases, the power and therefore the size of the heat exchangers must increase. Unfortunately, temperature dispersion is related directly to the size of the rectangular case. Thus, the temperature of the steam produced by the first nest disposed at the particles inlet is greater than the temperature of the last nest disposed at the outlet, which is not desirable.

Furthermore, nests that all withstand the maximum temperature of the case are avoided because that would be a costly solution. Therefore as many types of nest are provided as there are nests in a heat exchanger, each type of nest being dimensioned for an operating temperature which corresponds to its place in the case. Thus, the many advantages of having a single manufacturing line are lost.

SUMMARY OF THE INVENTION

An object of the present invention is to provide a heat exchanger system which makes it possible to obtain a substantially uniform temperature at the outlets of all of the nests in the second heat exchanger.

According to the invention, the heat exchanger system includes a first heat exchanger followed by a second heat exchanger disposed in a dense fluidized bed, the second heat exchanger being made up of a plurality of nests of tubes disposed along the path of the particles in suspension in the dense fluidized bed. In addition, with the second heat exchanger being provided with at least two feeds situated on either side of its center, each of the feeds receives a distinct mixture of the input fluid and of the output fluid of the first heat exchanger, so that the temperature of the fluid fed into each of the nests is an increasing function of the distance between it and the inlet via which the particles are fed into the dense fluidized bed.

The differences in the temperatures of the particles in the fluidized bed are thus compensated by the differences in the temperatures of the fluids that feed the various nests.

An effective solution, from a thermal point of view, when the second heat exchanger comprises more than two nests, is to provide each of the nests with its own specific feed.

However, a cheap solution consists in making provision for the feeds of the nests to be connected to a common manifold.

Advantageously, the nests are made up of zigzag tubes disposed in vertical and parallel planes.

In addition, the path of the particles is perpendicular to the planes in which said zigzag tubes are disposed.

A preferred embodiment consists in choosing all of the nests to be identical.

Advantageously, at least one of the mixtures of the input fluid and of the output fluid of the first heat exchanger is formed by means of regulating valves connected to the inlet and to the outlet of the first heat exchanger.

However, it is possible to make provision for at least one of the mixtures of the input fluid and of the output fluid of the first heat exchanger to be formed by means of a regulating valve connected either to the inlet of the first heat exchanger or to the outlet thereof.

BRIEF DESCRIPTION OF THE DRAWINGS

The invention appears in more detail from the following description of embodiments given by way of illustration and with reference to the accompanying drawings, in which.

Like elements shown in various figures are given like references.

DETAILED DESCRIPTION OF THE PREFERRED EMBODIMENTS

Only those components of the boiler which are necessary for understanding the invention are mentioned in the text below and shown in the figures.

Figure 1:
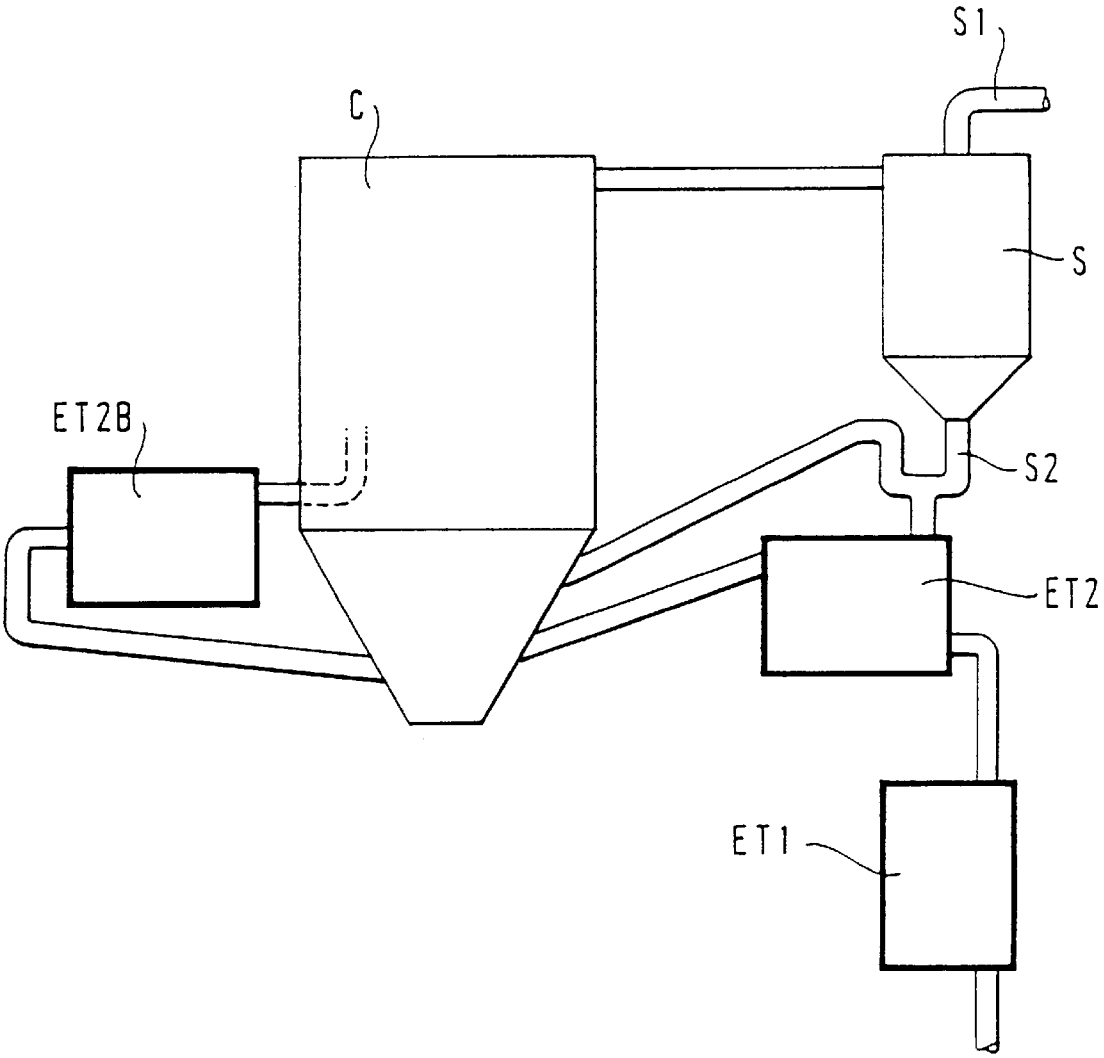
FIG. 1 is a diagram of a boiler to which the invention is applicable.
Figure 2:
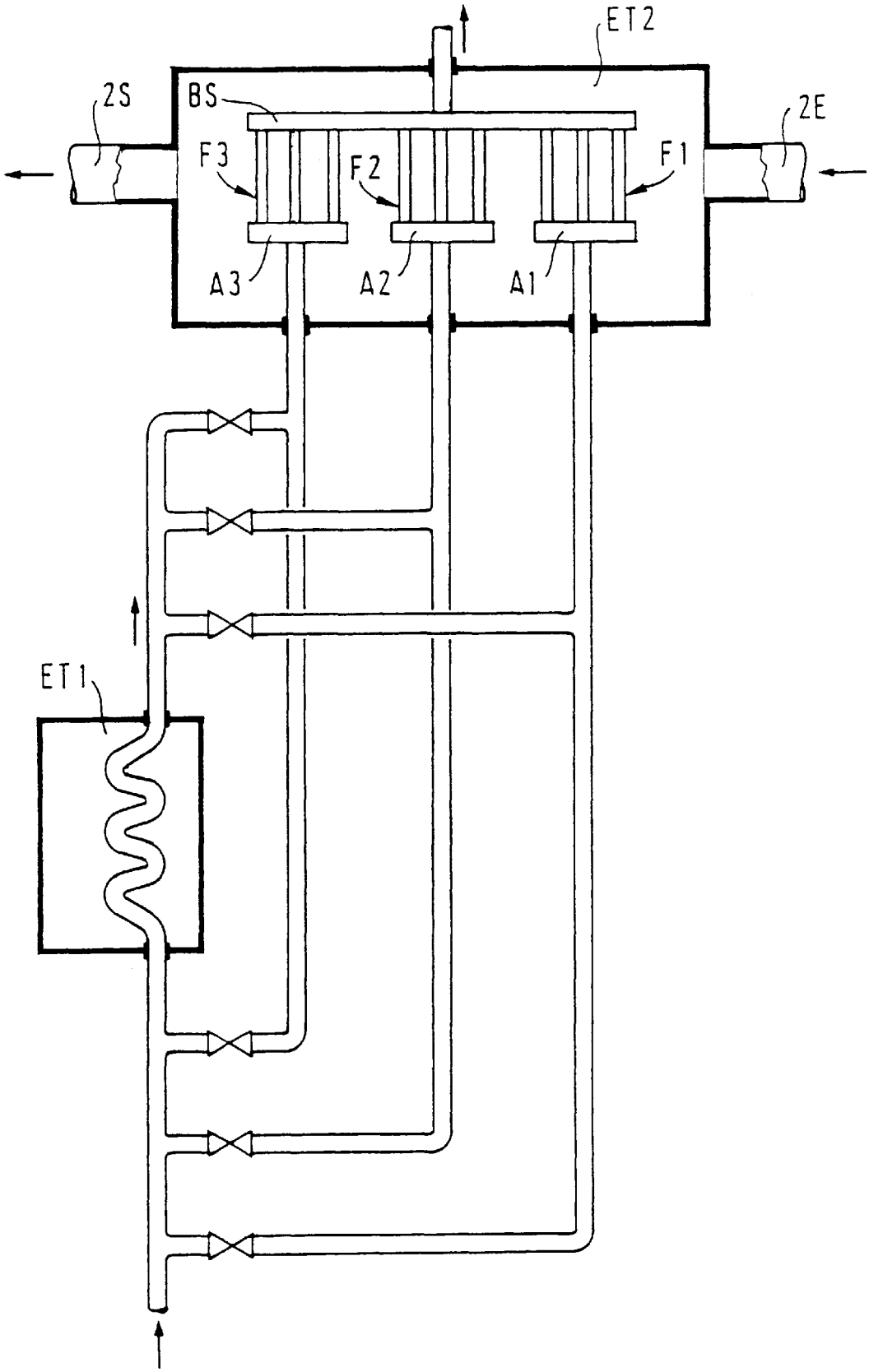
FIG. 2 shows a first embodiment of the invention.

FIG. 2 shows the first heat exchanger ET1 represented by a zigzag tube in an enclosure.

The dense fluidized bed ET2 is in the form of a rectangular case in this example. For the purposes of the description, the case as a whole is considered to be the second heat exchanger.

Inside the case, three nests of zigzag tubes F1, F2, F3 are shown, with three zigzag tubes in each nest, and the zigzag tubes extending in vertical planes that are perpendicular to the plane of the figure.

The case ET2 is connected to a particle inlet duct 2E on one of its walls that are parallel to the planes of the zigzag tubes, and it is connected to a particle outlet duct 2S on the opposite wall. In this configuration, the flow of particles is thus, on average, perpendicular to the planes of the zigzag tubes.

The first nest F1 is disposed in the vicinity of the particle inlet 2E and the third nest F3 is disposed in the vicinity of the outlet 2S.

Each nest F1, F2, F3 has its own feed A1, A2, A3 (an inlet manifold) while a common outlet manifold BS is provided for all of the nests.

Naturally, some other layout may be chosen for the nests, e.g. by disposing the planes of the zigzag tubes so that they are parallel to the flow of particles. It is possible to make provision for each nest to have its own outlet manifold.

The feed A1, A2, A3 of each of the nests is connected via two regulating valves to the inlet and to the outlet of the first heat exchanger ET1. The valves are thus regulated so that the output temperatures of the nests F1, F2, F3 are substantially identical.

This is the solution that offers the highest performance, but it is equally possible for the feed A1 of the first nest to be connected only to the inlet of the first heat exchanger ET1, and for the feed A3 of the third nest to be connected only to the outlet of said first heat exchanger ET1.

Likewise, either of the valves could be replaced merely with a diaphragm. Another embodiment consists in replacing the two valves associated with a feed with a three-port valve.

A person skilled in the art can well understand that there are numerous options available for feeding the nests at different temperatures, provided that one access is available per nest.

Figure 3:
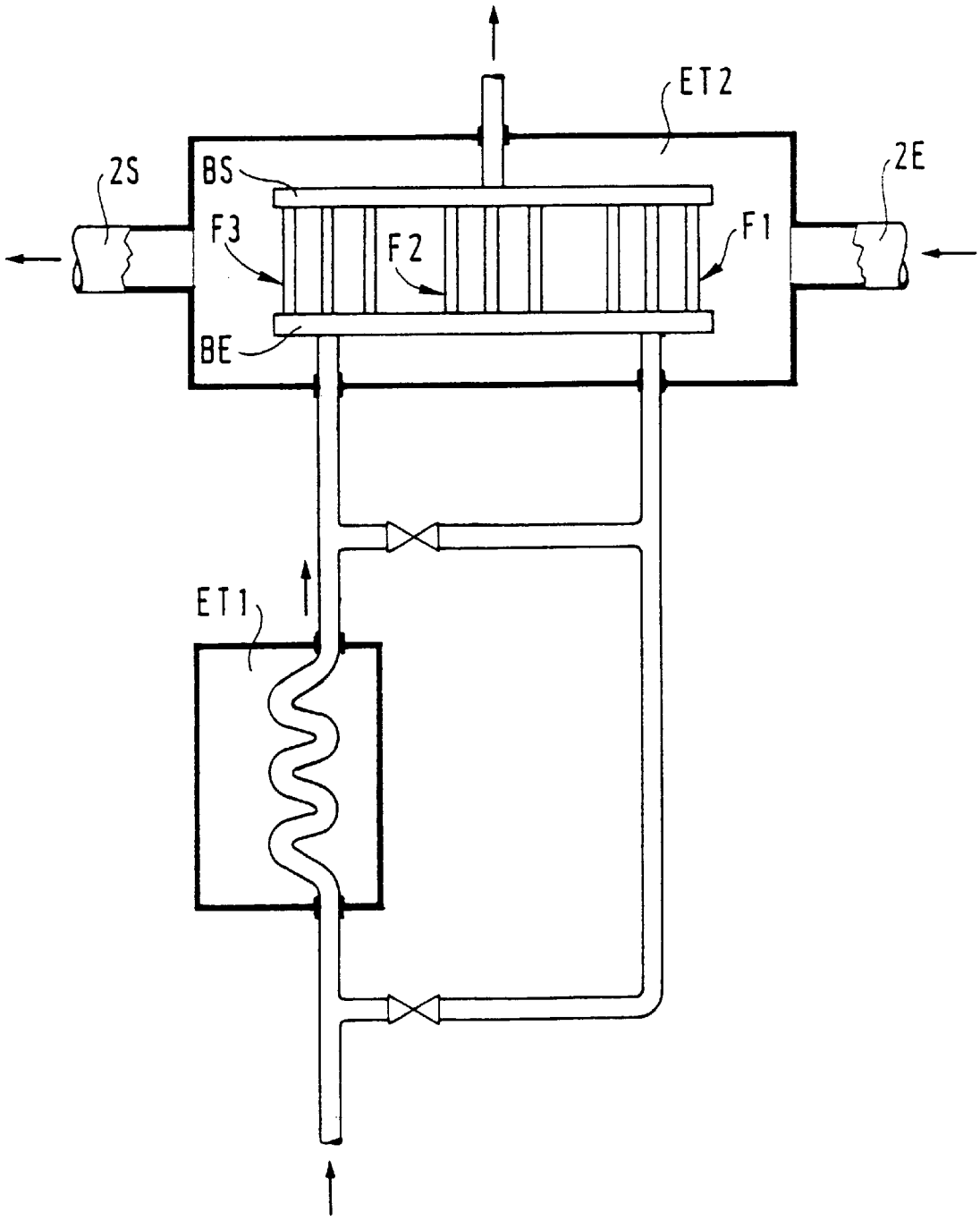
FIG. 3 shows a variant of the invention.

In a variant of the invention, shown in FIG. 3, a common inlet manifold BE is provided for all three nests.

That end of the manifold which is in the vicinity of the first nest is connected via two regulating valves to the inlet and to the outlet of the first heat exchanger ET1, while its end in the vicinity of the third nest is connected directly to the outlet of the first heat exchanger ET1.

The feeds of the inlet manifold BE may be offset so as not to be exactly at its ends: what matters is that two feeds must be available that are far enough apart and that are positioned on either side of the center of the inlet manifold.

In addition, the remarks made above with respect to the diversity of the options available for implementing the invention also apply in this example.

Similarly, it is also possible for the inlet manifold BE to be provided with an additional feed disposed substantially in its middle, which feed receives a mixture of the fluids coming from the inlet and the outlet of the first heat exchanger ET1.

Thus, the invention makes it possible to use static or regulated adjustment members to obtain steam or vapor at approximately the same temperature at the outlets of the various nests.

Naturally, the invention is applicable if there are two nests or if there are more than three nests.

The invention is also applicable if any element is interposed between the dense fluidized bed ET2 and the particle duct S2 of the separator member S (or else between the dense fluidized bed ET2B and the extraction duct of the hearth C if the dense fluidized bed ET2B is fed with particles collected in the hearth).

The invention is therefore not limited to the above-described embodiments, and it may be implemented in many different ways, e.g. by replacing any means with any equivalent means.

What is claimed is:

1. A heat exchanger system comprising;

a first heat exchanger having an inlet and an outlet through which a fluid is input and output, respectively;

a second heat exchanger disposed in a dense fluidized bed, and connected downstream from said first heat exchanger, the second heat exchanger including:

an inlet through which particles are fed into the dense fluidized bed in suspension, a plurality of nests of tubes disposed perpendicularly along the path of the particles in suspension in the dense fluidized bed, and at least two feeds situated on either side of a center of said second heat exchanger, each of said feeds receiving a predetermined mixture of the input fluid and of the output fluid of said first heat exchanger, so that a temperature of a fluid fed into each of said nests from said first heat exchanger is an increasing function of an increasing distance between each of said nests and the inlet via which the particles are fed into the dense fluidized bed; and wherein an output temperature at an outlet of each of the nests, is substantially equal.

2. A system according to claim 1, wherein said second heat exchanger comprises more than two nests, and each of the nests is provided with its own specific feed.

3. A system according to claim 1, wherein the feeds of said nests are connected to a common manifold.

4. A system according to claim 1, wherein said nests are made up of zigzag tubes disposed in vertical and parallel planes.

5. A system according to claim 4, wherein the path of the particles is perpendicular to the planes in which said zigzag tubes are disposed.

6. A system according to claim 1, wherein said nests are structurally identical.

7. A system according to claim 1, wherein said mixture of the input fluid and of the output fluid of the first heat exchanger is formed by means of regulating valves connected to the inlet and to the outlet of said first heat exchanger.

8. A system according to claim 1, wherein said mixture of the input fluid and of the output fluid of the first heat exchanger is formed by means of a regulating valve connected either one of to the inlet of said first heat exchanger and to the outlet thereof.

* * * * *